US007253369B2

(12) United States Patent
Fu et al.

(10) Patent No.: US 7,253,369 B2
(45) Date of Patent: Aug. 7, 2007

(54) BACKLIGHT BUTTON ASSEMBLAGE

(75) Inventors: Wen-Chi Fu, Miao-Li County (TW); Tai-Li Chang, Miao-Li County (TW)

(73) Assignee: Coretronic Corporation, Miao-Li County (TW)

( * ) Notice: Subject to any disclaimer, the term of this patent is extended or adjusted under 35 U.S.C. 154(b) by 0 days.

(21) Appl. No.: 11/285,177

(22) Filed: Nov. 23, 2005

(65) Prior Publication Data

US 2006/0203485 A1 Sep. 14, 2006

(30) Foreign Application Priority Data

Mar. 11, 2005 (TW) ..... 94107422 A

(51) Int. Cl.
*H01H 9/18* (2006.01)

(52) U.S. Cl. ..... 200/310; 200/314; 200/317

(58) Field of Classification Search ..... 200/310–317; 74/473.3; 341/22; 345/161, 168–170; 362/24, 362/29, 30, 88; 455/90.3, 550.1; 463/36–38
See application file for complete search history.

(56) References Cited

U.S. PATENT DOCUMENTS 5,039,832 A * 8/1991 Polacek et al. ..... 200/317
5,521,345 A * 5/1996 Wulc ..... 200/317
6,590,174 B2 * 7/2003 Zysnarski et al. ..... 200/310
6,855,899 B2 * 2/2005 Sotome ..... 200/317
6,933,453 B1 * 8/2005 Lee ..... 200/312
7,091,434 B2 * 8/2006 Suzuki ..... 200/316

FOREIGN PATENT DOCUMENTS

TW 1223295 11/1992
TW M248011 11/1992

* cited by examiner

*Primary Examiner*—Michael A. Friedhofer
(74) *Attorney, Agent, or Firm*—Birch, Stewart, Kolasch & Birch, LLP

(57) ABSTRACT

A backlight button assemblage includes an opaque button, a light-guiding element, and a light-emitting element. The light-emitting element is disposed under the button and light emitted from the light-emitting element is guided to the front side of the button via the light-guiding element surrounding the button. Light can therefore be evenly distributed over the light-guiding element, and uniformity of light achieved, so that partial dazzling spots are avoided, the quantity of light-emitting elements is reduced, and fabrication costs are saved.

12 Claims, 6 Drawing Sheets

BACKLIGHT BUTTON ASSEMBLAGE

FIELD OF THE INVENTION

The present invention relates to a structure of backlight button, particularly to a backlight button assemblage, which has an improved light-guiding structure.

BACKGROUND OF THE INVENTION

With the progress of science and technology, the utility and popularity of the electronic product grow obviously. In some places, such as conference room, interior of car or airplane, as light is dim, an operation of keyboard is difficult when a user operates electronic products, such as a computer, PDA, projector, mobile phone, etc.

To solve the above-mentioned problem, Taiwanese Utility Model Patent Publication No. M248011 discloses a backlight button. The backlight button includes a button body and a guiding element. The button body is transparent and the guiding element is extended from at least one side of the button body. A light-emitting element is disposed in a position of a printed circuit board (PCB), which corresponds to the button body, and an inching switch is disposed in the portion of the PCB, which corresponds to the guiding element. When a user presses the button, the guiding element actuates the inching switch to turn on the light-emitting element, and the light from the light-emitting element directly projects onto the button body, and thus, the button also emits light.

However, the transparent button results in the light projecting directly into the user's eyes, which incurs the discomfort for the user. Referring to FIG. 1, another conventional design of a backlight button includes an opaque button 10, a transparent light-guiding element 11 disposed along a perimeter of the button 10, and a light-emitting element 12 disposed under the light-guiding element 11. Via a light-guiding ability of the light-guiding element 11, the perimeter of the button 10 has a ring of backlight. But the design of installing the light-emitting element 12 under the light-guiding element 11 still results in dazzling spots on a light-exiting surface of the light-guiding element 11 and light non-uniformity. To lessen the light non-uniformity, it is necessary to evenly install more light-emitting elements 12 along the perimeter of the button 10 to achieve light uniformity. However, utilizing more light-emitting elements 12 results in more fabrication cost and power consumption.

SUMMARY OF THE INVENTION

An objective of the present invention is to provide a backlight button assemblage that can provide a light uniformity and can also avoid an appearing of partial dazzling spots and a light directly projecting into user's eyes.

Another objective of the present invention is to provide the backlight button assemblage that reduces a quantity of the light-emitting elements.

To achieve the aforementioned objectives, in one embodiment of the present invention, a backlight button assemblage includes an opaque button, a light-guiding element disposed along a perimeter of the button, and the light-emitting element disposed under the button. The light emitted from the light-emitting element is transmitted through a direct or a reflective path to the light-guiding element surrounding the perimeter of the button, and via a light-guiding ability of the light-guiding element, the light inside the light-guiding element is guided toward a front side of the button and transmits out. Thus, the light is evenly distributed over the light-guiding element to achieve the light uniformity and to avoid the partial dazzling spots, and the quantity of the light-emitting elements can be reduced, and the fabrication cost is saved.

Further scope of the applicability of the present invention will become apparent from the detailed description givin hereinafter. However, it should be understood that the detailed description and specific examples, while indicating preferred embodiments of the invention, are given by way of illustration only, since various chances and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
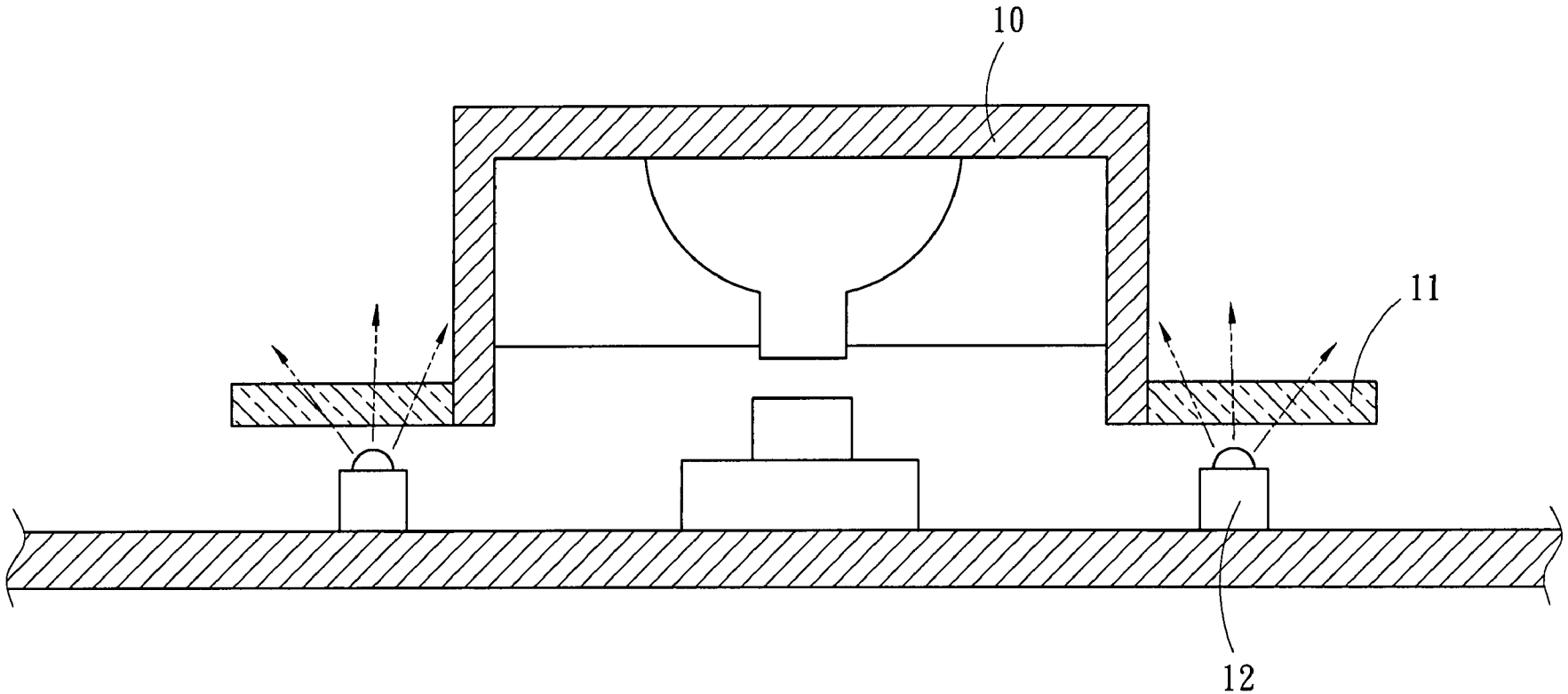
Fig. 1 PRIOR ART
FIG. 1 is the section view of a conventional backlight button.
Figure 2:
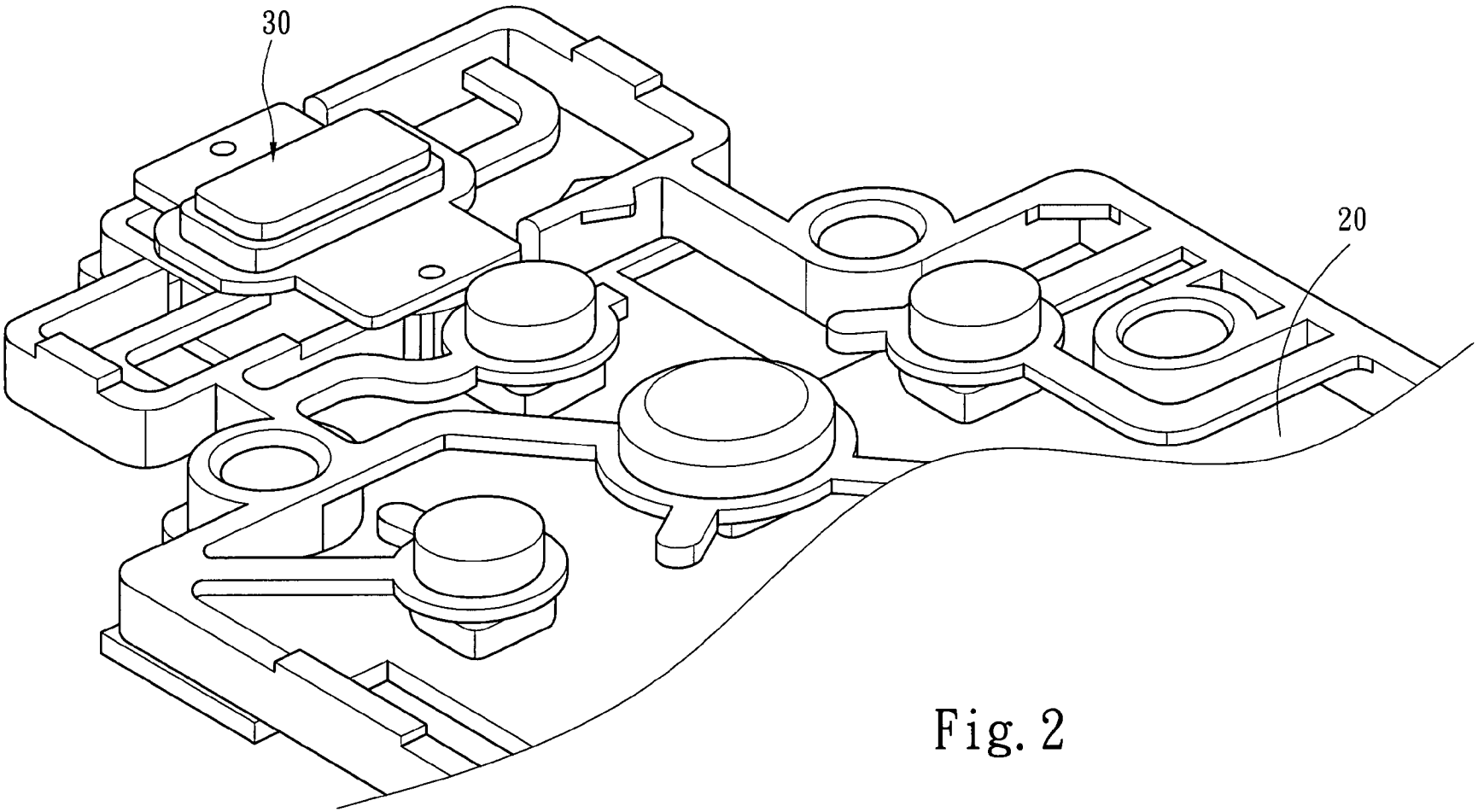
FIG. 2 is a structural diagram showing a backlight button assemblage of the present invention on a printed circuit board.
Figure 3:
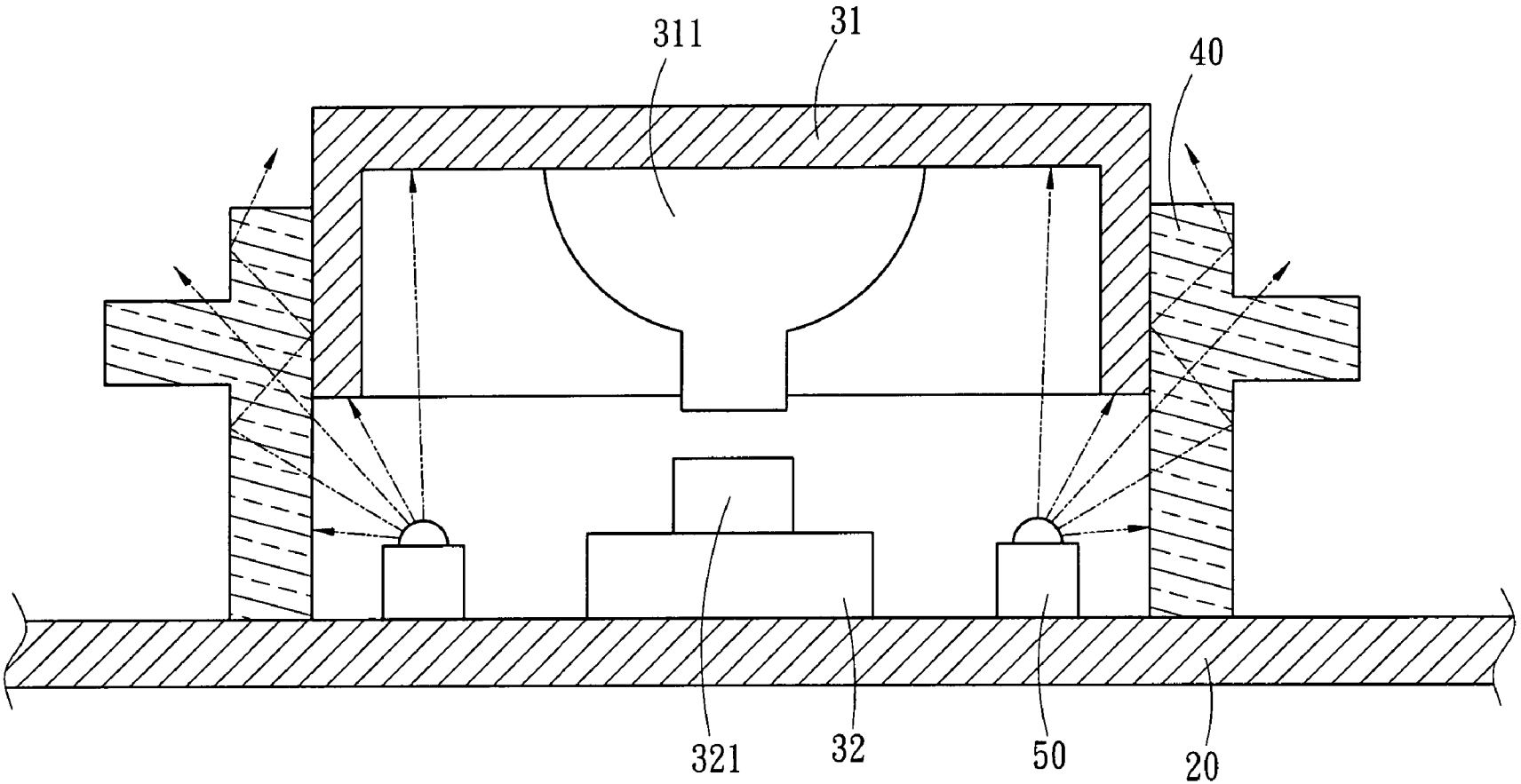
FIG. 3 is a section view along the line 3-3 in FIG. 4.

As shown in FIG. 2 and FIG. 3, according to the first embodiment of the present invention, a backlight button assemblage 30 includes a button 31, a light-guiding element 40, and at least one light-emitting element 50.

The button 31 is opaque and disposed above a switch 32. A bottom of the button 31 usually has a protrusion 311, which is used to press a contact end 321 of the switch 32. In a normal state, the button 31 is supported by support elements, such as a spring (not shown), or directly supported by the contact end 321 of the switch 32.

The light-guiding element 40 is transparent. The shape of light-guiding element 40 matched a contour of the button 31 and is disposed along the perimeter of the button 31, The light-guiding element 40 can not interfere with a movement of the button 31. The light-guiding element 40 is annular, and is fixed to or stands on the surface of a printed circuit board (PCB) 20. The light-guiding element 40 guides a light and is made of a transparent material, such as Polycarbonate (PC) or Acrylic, and Polycarbonate has higher transparency than Acrylic.

Figure 4:
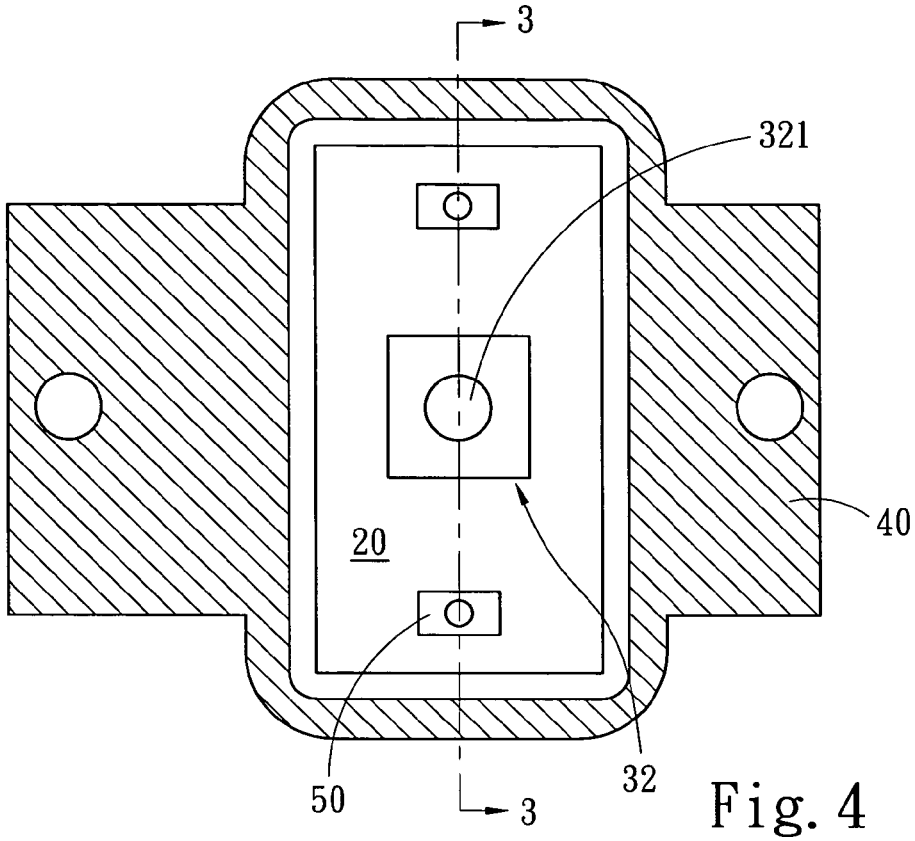
FIG. 4 is the schematic diagram showing a disposal of the light-emitting elements of the backlight button assemblage in a first embodiment of the present invention.
Figure 5:
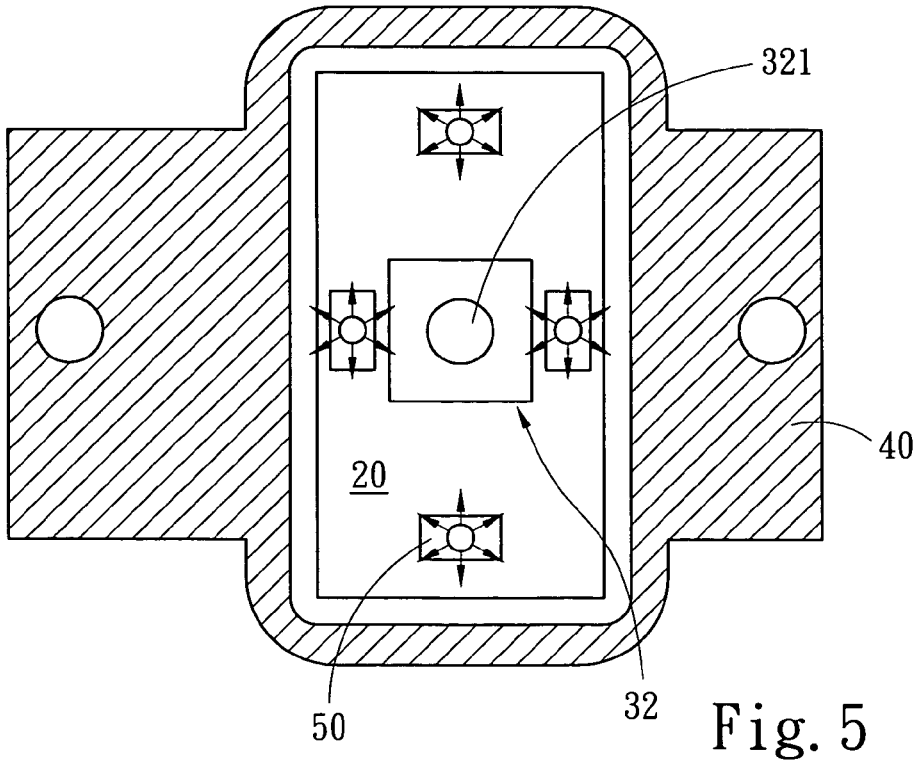
FIG. 5 is the schematic diagram showing another disposal of the light-emitting elements of the backlight button assemblage in the first embodiment of the present invention.

The light-emitting element 50 is disposed on the PCB 20 and in a rear of the button 31. The light-emitting element 50 is surrounded by the light-guiding element 40 and a directionless light emitting diode (LED) is a better choice of the light-emitting element 50. When the light-emitting element 50 is directionless, one portion of the light directly illuminates the light-guiding element 40, and the other portion of the light is reflected by the opaque button 31 and then enters the light-guiding element 40. Via a light-guiding ability of light-guiding element 40, the light inside the light-guiding element 40 is guided toward a front side of the button 31 and transmits out. Thus, the light can be uniformly distributed over the light-guiding element 40 to achieve the light uniformity and to avoid the partial dazzling spots. It is better to dispose the light-emitting element 50 in symmetric positions of which symmetric center is a central point of the button 31. For example, as shown in FIG. 4, two light-emitting elements 50 can be installed on an upper and a lower side of the central point of the button 31, or as shown in FIG. 5, four light-emitting elements 50 can be installed on four sides of the central point of the button 31. The number of the light-emitting elements 50 can be adjusted according to a brightness requirement of the backlight button assemblage 30.

The switch 32 is disposed below the button 31. In fact, the switch 32 is embodied in many ways. For example, a conventional switch is composed of a button cap, an elastic element, and a membrane circuit. The elastic element is coupled to an underneath of the button cap having a protrusion that is spaced out from the membrane circuit by a gap. The membrane circuit has a first electrical conductive portion and a second electrical conductive portion. In a normal state, a space between the first electrical conductive portion and the second electrical conductive portion is formed to keep them from contacting to each other. When the button cap is pressed down, the protrusion of the elastic element contacts the membrane circuit, which enables the first electrical conductive portion to contact the second electrical conductive portion, and thus, the circuit becomes electrical conductive. Further, Taiwanese Patent Publication No. I223295 discloses a space saving and a cost saving button switch. The first electrical conductive portion is installed on the elastic element and the second electrical conductive portion is installed on the membrane circuit. Via pressing the button cap, the first electrical conductive portion contacts the second electrical conductive portion to conduct electricity. Those mentioned above are only the supplementary description of the switch and not intended to represent the characteristics of the present invention, and each person skilled in the art should be able to understand and utilize those conventional technologies easily.

Figure 6:
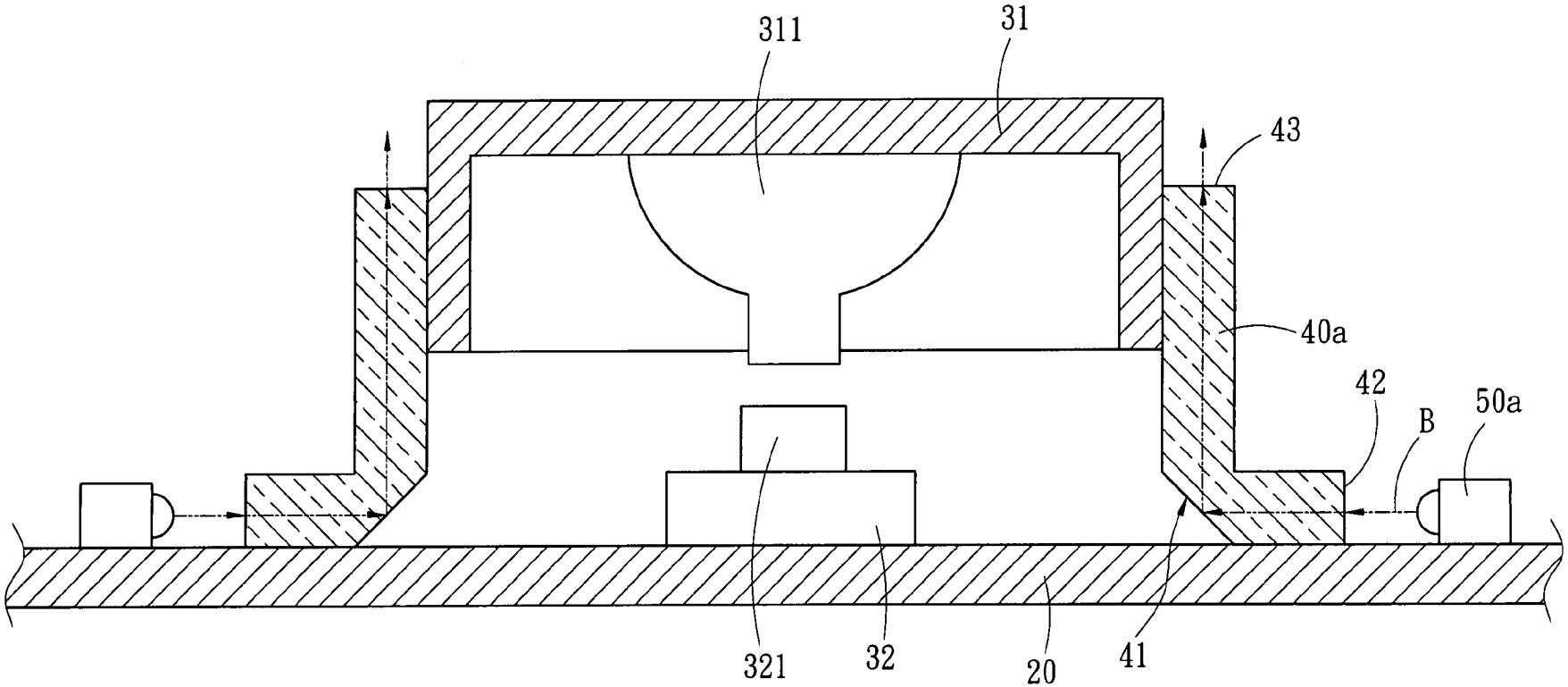
FIG. 6 is the section view of the backlight button assemblage in the second embodiment of the present invention.

Refer to FIG. 6, which discloses the backlight button assemblage in the second embodiment of the present invention, a directional light-emitting element 50*a* is adopted. In this embodiment, the objectives of the present invention are achieved via a modification of the shape of the light-guiding element and the position of the light-emitting element 50*a*. In this embodiment, the light-guiding element 40*a* is a transparent structure and has a L-shaped section, which has at least one corner 41. Two ends of the L-shaped transparent structure are a light incident surface 42 and a light-emitting surface 43 respectively. The light-emitting surface 43 surrounds the perimeter of the button 31. The light incident surface 42 is near and perpendicular to a surface of the PCB 20. The light-emitting element 50*a* is disposed in front of the light incident surface 42, and the light-emitting direction (indicated by the arrow B in FIG. 6) is parallel to the surface of the PCB 20. The light-emitting direction of a light emitted from light-emitting element 50*a* is parallel to a normal direction of said light incident surface 42. The light emitted from the light-emitting element 50*a* directly enters through the light incident surface 42 into the light-guiding element 40*a*. The corner 41 of the light-guiding element 40*a* has a reflective surface, which reflects the light from the light incident surface 42 to the light-emitting surface 43 where the light transmits out. Thus, the light from the light-emitting element 50*a* does not directly project into the user's eyes, and the light has been uniformly dispersed inside the light-guiding element 40*a* before the light transmits out.

Figure 7:
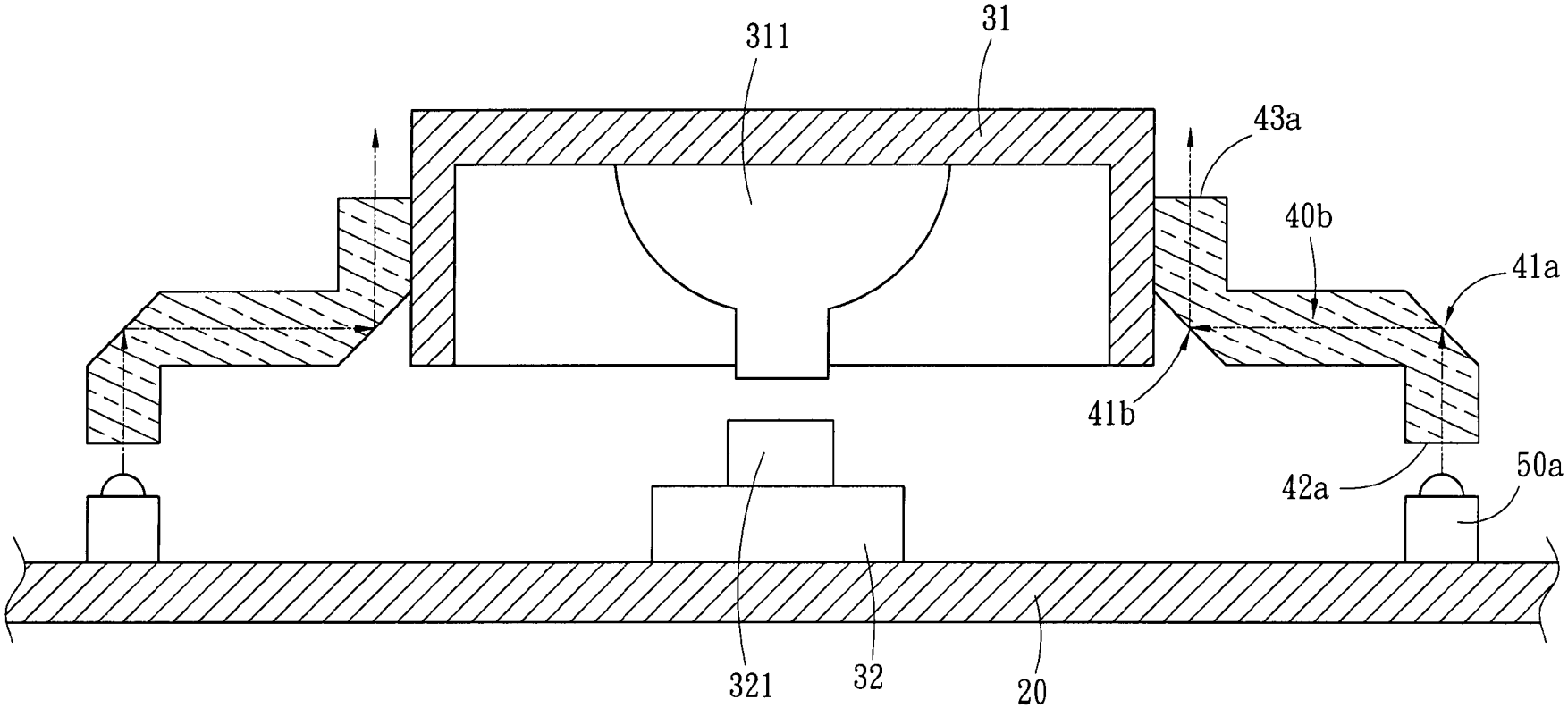
FIG. 7 is the section view of the backlight button assemblage in the third embodiment of the present invention.

FIG. 7 discloses the backlight button assemblage in a third embodiment of the present invention. In contrast to only one corner 41 in the second embodiment, in this embodiment, the light-guiding element 40*b* has two corners 41*a* and 41*b*. Each corner 41*a* and 41*b* has a reflective surface. The light-emitting element 50*a* stands vertically on the surface of the PCB 20 and below the light incident surface 42*a*. The light-emitting element 50*a* emits the light upward through the light incident surface 42*a* into the light-guiding element 40*b*. Then, the light is reflected twice by the reflective surfaces on the corner 41*a* and corner 41*b* respectively and thereafter projected from light-emitting surface 43*a*. The light-emitting direction of a light emitted from light-emitting element 50*a* is parallel to a normal direction of said light incident surface 42*a*. Thus, a uniform illumination is provided for the button 31.

In summary, the present invention adopts the opaque button, and the light-guiding element is disposed along the perimeter of the button; further, the light-emitting elements are disposed in the positions where the light-emitting element can not been directly seen from the exterior of the button, such as the position rear of the button or the lateral side of light-emitting surface of the light-guiding element, in order to avoid the partial dazzling spots resulting from the unevenly dispersed light or the light emitted from the light-emitting element directly projected into the user's eyes. The light emitted from the light-emitting element is projected to the light-guiding element surrounding the button via the direct or reflective path, and the light is evenly dispersed and guided to transmit out from the front of the button via the light-guiding ability of the light-guiding element. Thus, the objective of light uniformity is achieved, and the partial dazzling spots are avoided.

The preferred embodiments mentioned above are only to clarify the present invention and not intended to limit the scope of the present invention, and any modification or variation made by the person skilled in the art according to the spirit of the present invention is to be included within the scope of the present invention.

What is claimed is:

1. A backlight button assemblage, comprising:

an opaque button;

a plurality of light-emitting elements, disposed under and in a symmetric position of a symmetric center of said button; and a light-guiding element, surrounding said button and guiding a light emitted from said light-emitting element to transmit out from a front of said button.

2. The backlight button assemblage according to claim 1, wherein said light-emitting element is a light-emitting diode.

3. The backlight button assemblage according to claim 2, wherein said light-emitting element is a directionless light-emitting diode.

4. The backlight button assemblage according to claim 1, wherein a shape of said light-guiding element matches a contour of said button.

5. The backlight button assemblage according to claim 1, wherein said light-guiding element has at least one corner.

6. The backlight button assemblage according to claim 5, wherein said corner has a reflective surface reflecting said light horn said light-emitting element, and wherein the reflected light is guided to the front of said button and transmits out the front said button.

7. A backlight button assemblage, comprising:

a button;

a light-guiding element, surrounding said button and having at least one corner, a light incident surface, and a light-emitting surface, wherein said corner is disposed between said light incident surface and said light-emitting surface; and a plurality of light-emitting elements, disposed in the front of said light incident surface and in a symmetric position of a symmetric center of said button, wherein the light-guiding element guides a light emitted from said plurality of light-emitting elements to transmit out from a front of said button.

8. The backlight button assemblage according to claim 7, wherein said light-emitting element is a light-emitting diode.

9. The backlight button assemblage according to claim 7, wherein said button is an opaque element.

10. The backlight button assemblage according to claim 7, wherein said light-emitting element is a directional light-emitting element.

11. The backlight button assemblage according to claim 7, wherein said corner of said light-guiding element has a reflective surface reflecting the light emitted from said light-emitting element, and wherein the reflected light is guided to the front of said button and transmits out the front of said button.

12. The backlight button assemblage according to claim 7, wherein said a light-emitting direction of a light emitted from light-emitting element is parallel to a normal direction of said light incident surface.

* * * * *